United States Patent [19]

Ales, Jr.

[11] 4,026,487

[45] May 31, 1977

[54] DRUM UNWIND SYSTEM FOR SHEET MATERIALS

[75] Inventor: Thomas M. Ales, Jr., Neenah, Wis.

[73] Assignee: Kimberly-Clark Corporation, Neenah, Wis.

[22] Filed: Dec. 8, 1975

[21] Appl. No.: 638,332

[52] U.S. Cl. ..... 242/65

[51] Int. Cl.[2] ..... B65H 17/08

[58] Field of Search ..... 242/65, 54 R, 55, 67.1 R, 242/67.2, 67.3 R, 67.4

[56] References Cited

UNITED STATES PATENTS

| | | | |
|---|---|---|---|
| 2,569,797 | 10/1951 | Campbell | 242/65 |
| 3,503,567 | 3/1970 | Casey | 242/65 X |
| 3,702,687 | 11/1972 | Hall | 242/65 |

*Primary Examiner*—Edward J. McCarthy
*Attorney, Agent, or Firm*—Daniel J. Hanlon, Jr.; William D. Herrick; Raymond J. Miller

[57] ABSTRACT

An apparatus and method for unwinding wound sheet material in a drum unwind operation are described. The drum of the unwind equipment peripherally engages the material to be unwound in a pressure nip. The drum has a soft covering which deforms readily in the pressure nip while the roll being unwound is not subject to significant deformation in the nip. The roll being unwound then has the same diameter throughout the roll and sagging of the material at the nip is eliminated. The deformable roll or covering must be more easily deformed than the roll of material and for optimum operation is much more easily deformed to the extent that the deformation is visible to the eye.

8 Claims, 4 Drawing Figures

DRUM UNWIND SYSTEM FOR SHEET MATERIALS

BACKGROUND OF THE INVENTION

This invention relates to a drum unwind system for sheet materials in roll form such as rolls of paper, tape and the like.

Drum unwinds for the unwinding of rolls of sheet material commonly include a hard surfaced unwind drum such as a metal drum. The drum for the purpose of effecting the unwinding of the sheet material is placed against the periphery of the roll of sheet material so that a pressure nip between the peripheries of the drum and the roll is formed. Also, the roll of sheet material is mounted to be free to rotate and the drum drives the roll in rotation through the pressure existing in the nip between the drum and roll. As the unwinding of the roll takes place, the sheet material is drawn from the nip and is passed to other devices such as reels, forming boards and the like.

The pressure in the nip between the rolls as the diameter of the roll of material decreases is maintained in any convenient manner as by use of the air cylinders. For this purpose, of course, either the roll of material or the drum is mounted to be moved transversely of its axis by the action of the air cylinders.

The mentioned unwind system of the prior art is useful but suffers from certain drawbacks. A first of these is that commonly the roll of sheet material termed, for convenience, the parent roll is more subject to deformation radially than is the unwind drum. This leads to a condition in which the lineal speed of the parent roll in the pressure nip differs from the surface speed of the remainder of the roll.

Stated somewhat differently, the diameter of the parent roll as measured from the nip radially is less than the diameter of the parent roll and all other undeformed portions of the roll. A sag in the material being unwound then occurs. The difficulty mentioned is particularly apparent with sheets of material which are of low stretch and/or are of low strength.

A primary purpose of the present invention is to provide a novel method for the unwinding of rolls of sheet material utilizing an unwind drum system in which the unwind drum has a surface of a material which deforms much more easily than the roll of material to be unwound.

An important object of the invention is to provide a drum unwind system in which the unwind drum has a covering of a very soft deformable foam material. A further object of the invention is to describe novel apparatus arrangement for unwinding sheet material.

The invention will be more fully understood by reference to the following detailed description and accompanying drawings wherein.

Figure 1:
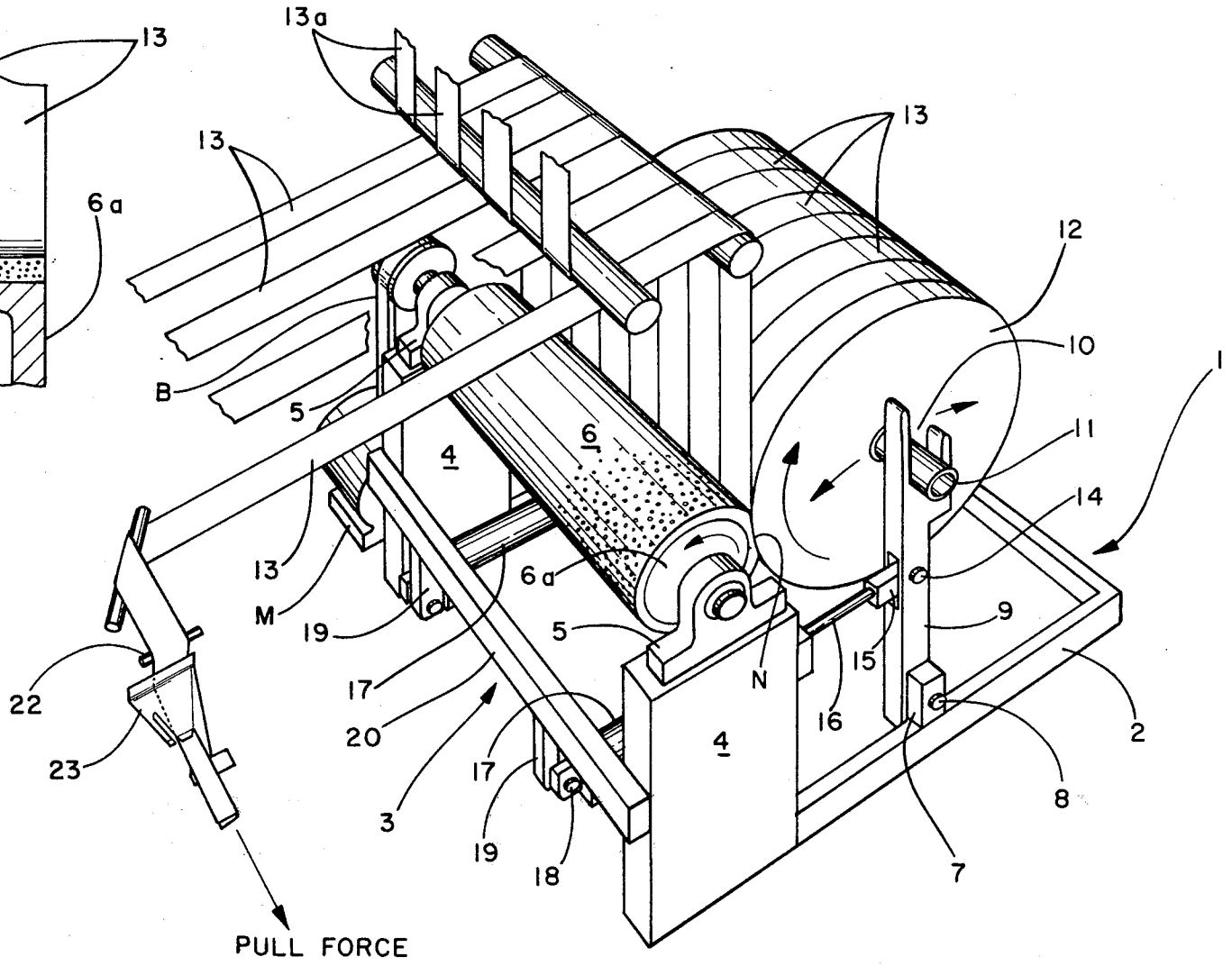
FIG. 1 is a schematic perspective view of a drum unwind system in accordance with the invention.

Referring now in more detail to the drawings and initially particularly to FIG. 1, the numeral 1 generally designates the frame of the equipment. The equipment includes a U-shaped base 2 which is open rearwardly at 3. The rearward portion of the frame 2 includes a pair of oppositely disposed unstanding pedestals 4. Surmounting each pedestal 4 is a pillow block 5. The numeral 6*a* designates a metal roll journalled in the pillow blocks 5. The roll 6*a* itself has a soft compressible readily deformable covering 6 of polyether foam.

Figure 2:
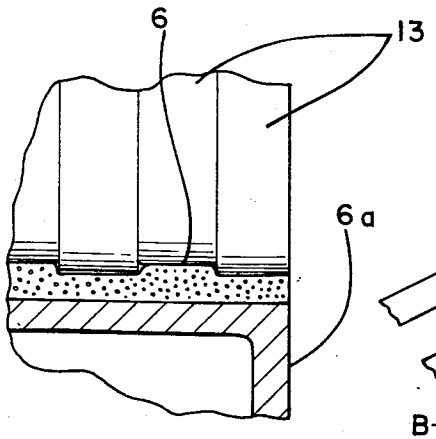
FIG. 2 is a fragmentary view illustrating the nip relationship between the unwind drum and material to be unwound.

The base 2 supports on opposite sides, and only one of which is shown in FIG. 1, fixed blocks as at 7. As indicated, block 7 includes stud shaft 8 which pivotally receives a standard 9. The two standards, one on each of the opposite sides of the base 2, are transversely slotted at their upper ends to provide, as indicated at 10, an open bearing structure for receipt of a spindle 11. As shown, spindle 11 itself mounts a roll 12 of wound sheet material. In the present example the sheet material is divided axially into a plurality of strips 13 and 13*a* to be unwound. The roll 12 with the soft covering 6 of the unwind roll forms, as shown in FIGS. 1 and 2, particularly a pressure nip N.

In operation the roll 6*a* is driven from any suitable source of power such as motor M and belt B in conventional manner. The roll 12 is then driven by friction from roll 6*a*. The rotational directions are shown in FIG. 1.

In order to maintain the nip pressure as roll 12 is decreased in diameter in the unwinding operation, provision is made for moving the roll 12 leftwardly in FIG. 1 against the fixedly positioned unwind roll. This mechanism includes the mentioned blocks 7 and a pair of oppositely disposed air cylinders pivoting each standard 9 leftwardly in FIG. 1 on the blocks. In connection with the air cylinder drives, numeral 14 indicates a stud which receives a clevis 15 on the end of a piston rod 16 of the air cylinder having the housing indicated at 17. The air cylinders in their operation are well-known and the connecting equipment for the supply of air is not shown in the drawings as the specific mode of air supply has no relation to the present invention. The housing 17 is pivotally connected to stud shaft 18 which extends from vertical support 19. Support 19 itself depends from the cross brace bar 20.

Figure 3:
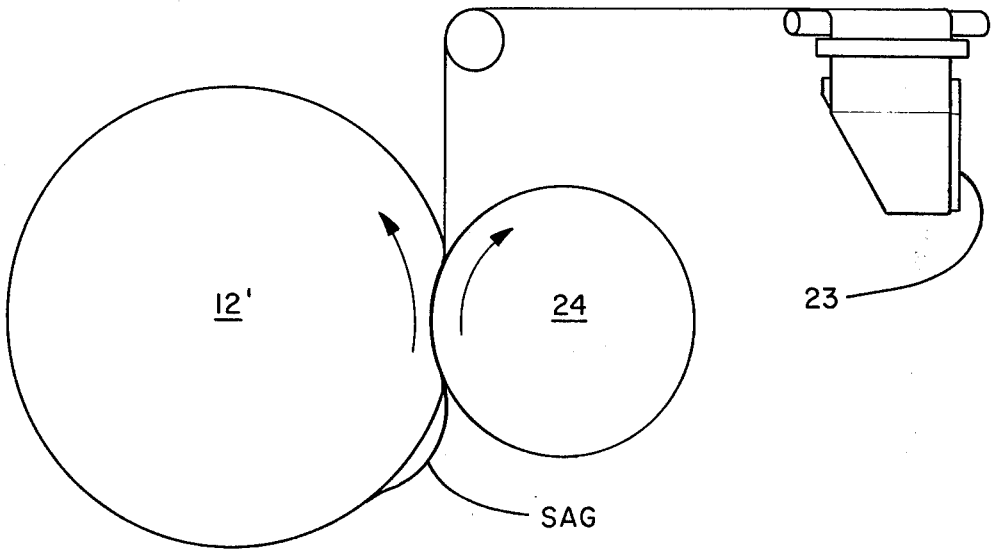
FIG. 3 (PRIOR ART)
FIG. 3 is a schematic view illustrating the sag which occurs in the normal prior art unwind drum system.

Referring now to FIG. 3, in prior art practice the drum indicated at 24 which drives the parent roll 12′ would normally be harder than the parent roll. The parent roll would then tend to be deformed by the pressure existing at the peripheries of the roll and drum. It is considered that the reason for the sag of the material is that the diameter of the parent roll as measured from the nip is less than the diameter of the parent roll at other places on a roll surface and, consequently, the lineal speed in the nip of the parent roll is somewhat decreased over that of the remainder of the roll circumference. This decrease in speed as the material being withdrawn from the parent roll enters the nip causes the indicated sag.

Figure 4:
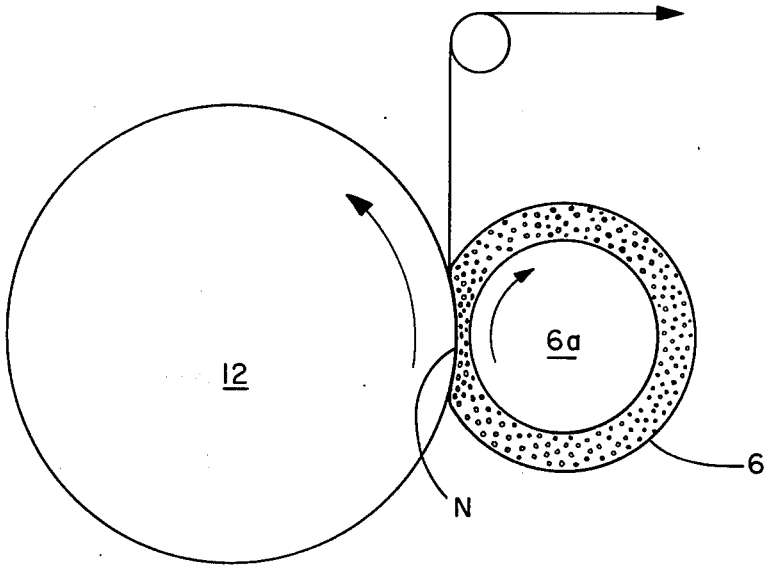
FIG. 4 is a view similar to that of FIG. 3 but illustrating the principle of the present invention whereby the mentioned sheet sag is eliminated.

In accordance witn the present invention as illustrated in FIG. 4, the drum 6*a* has the covering 6 which is highly deformable at least to about one-half of the covering thickness when under pressure and, importantly, the parent roll has no significant distortion in the nip. Accordingly, the diameter of the parent roll is the same whether measured from a nip area or otherwise. The speed of the sheet material being withdrawn is then the same in the nip as elsewhere. This eliminates sag from the sheet material.

As may be seen from FIG. 2, not only is sag eliminated but the arrangement of the invention is effective in instances where the roll hardness or other characteristic vary such that the roll deforms differentially in the pressure nip. Thus, for example, each one of the strips 13 may be (FIG. 2) less deformable than an adjacent strip and will deform the soft covering 6 much less and withdrawal of the plurality of strips in the manner indicated in FIG. 1 is facilitated.

In the operation of the device of the present invention it is important that the withdrawal of the unwinding material from the nip N be in a direction normal or perpendicular to the zone of contact of the peripheries of the unwind drum, and the material being unwound. Specifically, it is important that the unwinding material not be permitted to wrap the soft deformable covering 6. It is preferable in some instances that the unwinding material be guided into a very slight wrap with the material being unwound to avoid any possibility of the unwinding material following the soft covering 6.

In the embodiment illustrated the soft covering 6 was of a polyether foam and approximately ¾ inch thick. The material being unwound is a paper sheet material having a relatively low stretch characteristic. The strips designated 13 were withdrawn from the sheet material roll in such a manner as to avoid wrapping of the covering 6 as already noted, and were then passed to guide bars 22 and to a folding board 23 for sheet folding. The deformation of the ¾ inch thick covering when under nip pressure in sheet withdrawal was such that the form thickness was about ¼ inch thick. The resiliency of the foam, however, is such that it re-expands immediately outside the nip and the issuing sheet of paper or the like must be maintained clear of the re-expanding foam to avoid gripping of the sheet. In general, the pressure is applied only that sufficient to drive the unwinding roll without slippage. Foam materials preferred for the purpose are the polyether and polyester foams which compress readily, for example, under finger pressure. However, the important factor is that the foam compresses under pressure application in circumstances in which the sheet material roll compresses or deforms substantially not at all.

The strips 13*a* staggered in relation to the strips 13 were similarly withdrawn from the sheet material and passed to other folding boards. The sheet material of the rolls to be unwound may be paper, creped tissue paper, nonwoven fabrics and the like and the system is of particular utility in instances in which the sheet material is of low strength and low stretch. It is also of considerable utility where toilet tissue is to be formed such as in the manner of strips 13 and 13*a*.

As many apparently widely different embodiments of this invention may be made without departing from the spirit and scope thereof, it is to be understood that I do not limit myself to the specific embodiments thereof except as defined in the appended claims.

I claim:

1. In a drum unwind system in which a roll of sheet material is unwound by withdrawing sheet material from the roll circumference at a pressure nip formed between the roll and an unwind drum which drives the roll in rotation, a covering for the unwind drum which is continuous and deformable more easily in the pressure nip than the roll of material such that the roll of material is not deformed radially in the pressure nip.

2. In a drum unwind for a roll of sheet material, in combination, a roll of sheet material to be unwound by withdrawing sheet material from the roll circumference, a drum having its periphery engaging the periphery of the roll of sheet material and forming a pressure nip with the roll of sheet material, said drum engagement being a driving connection with the roll of sheet material such that the roll is driven in rotation by the drum and withdrawal of sheet material from the roll is through the pressure nip, said drum having a peripheral resilient covering which is continuous and more readily deformable than the roll of sheet material such that the diameter of the roll of sheet material is not significantly decreased by the pressure in the pressure nip, and means for withdrawing unwound material from the pressure nip substantially free of the drum unwind covering.

3. In a drum unwind as claimed in claim 1 in which the resilient covering is a substantial thickness of a foam which is decreased by at least one-half of its thickness under the pressure in the said nip.

4. In combination, a wound roll of sheet material mounted for free rotation about its longitudinal axis and a resilient driven pressure roll having a continuous resilient surface and having an axis which extends parallel to the axis of the wound roll, said pressure roll engaging the wound roll peripherally and defining a pressure nip through which the sheet material is withdrawn in the unwinding of the said wound roll, and means urging the wound roll of sheet material and the resilient roll into said peripheral engagement sufficiently to deform the resilient pressure roll so that the speed of movement of a sheet in the nip is at least as great as the surface speed of the sheet material in the unwound portion of the roll.

5. Apparatus for unwinding a wound roll of sheet material comprising support means for a roll of material to be unwound, said support means defining a first axis of rotation, means for withdrawing sheet material from a wound roll as a wound roll is freely rotated on the said first axis of rotation, a resilient driven pressure roll having a second axis of rotation and which is parallel to the first axis of rotation, said roll being mounted for engagement peripherally with a wound roll on the first axis of rotation and whereby the resilient pressure roll and a wound roll define a pressure nip through which the sheet material is withdrawn, said resilient pressure roll having a continuous resilient surface and being deformable peripherally in the pressure nip so that the sheet speed in the nip is at least as great as the sheet surface speed in the unwound portion of the roll, and means for maintaining the said pressure nip as material is unwound and the diameter of a wound roll decreases.

6. A method of unwinding sheet material from a roll which comprises engaging the circumference of the roll to be unwound with the periphery of a drum having a covering which is continuous and deformable under pressure much more readily than the roll of material so that a pressure nip is formed between the drum and roll in which the covering is deformed radially but the roll is essentially undeformed radially, driving the roll of sheet material in rotation by driving the drum so that sheet material is removed from the circumference of the roll at the nip, and guiding the sheet material away from the covering of the drum surface as the sheet material leaves the said nip.

7. The method as claimed in claim 6 in which the nip pressure is such relative to the deformability of the covering that the covering in the nip is decreased by at least one-half of its thickness.

8. The method as claimed in claim 6 in which the resilient covering of the drum re-expands as it rotates free of nip pressure and the sheet material is guided from the nip toward the roll of sheet material and away from the re-expanding sheet material.

* * * * *